US005381960A

United States Patent [19]

Sullivan et al.

[11] Patent Number: 5,381,960

[45] Date of Patent: Jan. 17, 1995

[54] WOBBLING IRRIGATION SPRINKLER HEAD INCLUDING A MAGNET FOR INITIAL TILT

[75] Inventors: Harry D. Sullivan, Monument, Colo.; James R. Claybrooke, Orlando; William McFadden, Clermont, both of Fla.

[73] Assignee: Senninger Irrigation, Inc., Orlando, Fla.

[21] Appl. No.: 110,703

[22] Filed: Aug. 23, 1993

[51] Int. Cl.[6] ..... B05B 3/04; B05B 15/10

[52] U.S. Cl. ..... 239/222.21; 239/728; 239/734; 239/222.17; 239/232; 239/DIG. 11

[58] Field of Search ..... 239/722, 726, 728, 734, 239/222.11, 222.17, 222.21, 225.1, 231, 232, DIG. 11

[56] References Cited

U.S. PATENT DOCUMENTS

| | | | |
|---|---|---|---|
| D. 253,364 | 11/1979 | McFadden | 239/222.21 X |
| 3,009,648 | 7/1958 | Hait | 239/201 |
| 3,034,728 | 6/1960 | Hruby, Jr. | 239/206 |
| 3,091,400 | 5/1963 | Aubert | 239/264 |
| 3,312,400 | 4/1967 | Clearman | 239/222.21 X |
| 4,356,972 | 11/1982 | Vikre | 239/222.17 |
| 4,487,368 | 12/1984 | Clearman | 239/229 |
| 4,773,594 | 9/1988 | Clearman | 239/229 |
| 4,795,100 | 1/1989 | Purtell et al. | 239/734 |
| 4,949,905 | 8/1990 | Jones et al. | 239/273 X |

*Primary Examiner*—William Grant

*Attorney, Agent, or Firm*—William M. Hobby, III

[57] ABSTRACT

A wobbling irrigation sprinkler head is provided for use on a self-propelled mechanically moving irrigation system, such as a center pivot field irrigation system having the wobbling sprinkler head facing downward from the water supply conduit. The sprinkler head has a base for attaching to a pipe or to the central water supply conduit which base has nozzle mounted therein for directing water against a wobbling water deflecting head which is movably attached to the base and supports a deflector pad. The deflector pad has a deflection surface of predetermined shape with water deflecting grooves formed therein for rotating and wobbling the water deflecting head. The deflecting head has a loose fitting sleeve portion surrounding a support arm on the base and the base has a removable nozzle insert holder having a flange to loosely hold the deflecting head thereto. A magnet is mounted in the sprinkler head base to attract a ferric metal washer mounted the sprinkler head wobbling deflecting head to tilt the wobbling water deflector head relative to the base to cock the deflector head to initiate the wobbling in the deflector head.

15 Claims, 2 Drawing Sheets

WOBBLING IRRIGATION SPRINKLER HEAD INCLUDING A MAGNET FOR INITIAL TILT

BACKGROUND OF THE INVENTION

The present invention relates to a wobbling irrigation sprinkler head and especially to a wobbling sprinkler head for mounting to a central pivot irrigation system or the like.

It has become common practice to use center pivot irrigation systems in the irrigation of large fields and these typically comprise a long water conduit which is pivotally connected at one end to a source of water under pressure. The conduit arm is carried in an elevated position by a plurality of spaced wheels or wheel towers which are powered by hydraulic, pneumatic, or electric motors to rotatably sweep the central conduit over a circular pattern in a field. The central conduit includes a plurality of water sprinkling heads spaced over its length for distributing a spray of water on the circular field area as the center pivot irrigation conduit passes thereby. Center pivot irrigation systems have been successful for uniform distribution of water over a field crop and initially were operated at reasonably high water pressures. Current systems typically work with a somewhat lower water pressure and require that sprinkler heads distribute water evenly as the center pivot irrigation conduit moves through a field. A typical patent for a center pivot irrigation system can be seen in the Vikre patent, U.S. Pat. No. 4,356,972, which mounts the sprinkler heads on top of the central irrigation center pivot conduit. The sprinkler head uses a deflector head for deflecting the water with a grooved deflector pad. Other self-propelled mechanically moving irrigation machines can irrigate in a different manner, such as moving laterally in a straight line through a field.

There have been a number of wobbling sprinkler heads used in the past in which the water distribution head of the sprinkler, instead of being rotated in a smooth rotation or instead of following one of the other sprinkler patterns, has a water distribution head which wobbles in a rotating fashion to provide a more even distribution of water. In addition, the wobbling sprinkler head is sometimes rotated to provide a rotating sprinkler having a wobbling head the end thereof. In the Clearman patent, U.S. Pat. No. 4,487,368, and in the Clearman patent, U.S. Pat. No. 4,773,594, a control pattern wobbling sprinkler is provided in which a rotating sprinkler head has a wobbling water distribution head mounted on the end thereof which has a plurality of vanes formed in the wobbling portion of the head to force a wobbling motion which results from the loose connection between the distribution head and the supporting arm of the sprinkler head. In the sprinkler of these two patents, a base is provided for ground support and a rotating sprinkler head has the end of the rotating arm bent at an angle so that the loosely attached wobbling head tilts groundward when not being used. Upon initiation of water under pressure to the head, the head is already in a cocked position and forces a rotating action which causes a wobbling rotation of the water head portion. In the J. M. Hait patent, U.S. Pat. No. 3,009,648, an irrigation system is provided in which the sprinkler head has a rotating stream of water issuing therefrom but allows a deflection head to move back and forth. In the J. O. Hruby, Jr. patent, U.S. Pat. No. 3,034,728, a lawn sprinkler is shown which has a centrally disposed and vertically extending stem which is made to rotate by the action of the water passing through the sprinkler. The stem is loosely mounted and has an uneven deflecting portion to produce a rotating action of the spray. In the M. S. Aubert patent, U.S. Pat. No. 3,091,400, a dishwashing machine has a rotary wobbling spring head which is driven by the water momentum to wobble the head in a dishwasher.

In the present invention, a wobbling sprinkler head is used on a central pivot irrigation system or the like in which the sprinkler head is attached to a water pipe from the top of the central pivot water supply and forms a "U" in the pipe to hold the sprinkler head in an upright position. A wobbling sprinkler head of the present type requires that the head be cocked in some manner in order to initiate the wobbling of the loosely held head portion and utilizes a magnet working in connection with a ferric metal washer mounted in the sprinkler head base and in the deflection head to force a tilt in the deflection head portion when water pressure is not driving the wobbling sprinkler head. In addition, specially designed water deflecting grooves in the deflection pad helps initiate the wobbling and rotation of the deflection head to provide a more even distribution of water by the wobbling action as the sprinkler head distributes water during the movement of the central water supply conduit moving through a field on wheeled supports.

SUMMARY OF THE INVENTION

A wobbling irrigation sprinkler head is provided for use on a self-propelled mechanically moving irrigation machine, such as a center pivot field irrigation system, having the wobbling sprinkler head facing downward from the water supply conduit. The sprinkler head has a base for attaching to a pipe or to the center pivot conduit which base has a nozzle mounted therein for directing water against a wobbling water deflecting head which is movably attached to the base and supports a deflector pad. The deflector pad has a deflection surface of predetermined shape with water deflecting grooves formed therein for rotating and wobbling the water deflecting head. The deflecting head has a loose fitting sleeve portion surrounding a support arm on the base and the base has a removable nozzle insert holder having a flange to loosely hold the deflecting head thereto. A magnet is mounted in the sprinkler head base to attract a ferric metal washer mounted in the sprinkler head wobbling deflecting head to tilt the wobbling water deflector head relative to the base to cock the deflector head to initiate the wobbling in the deflector head.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
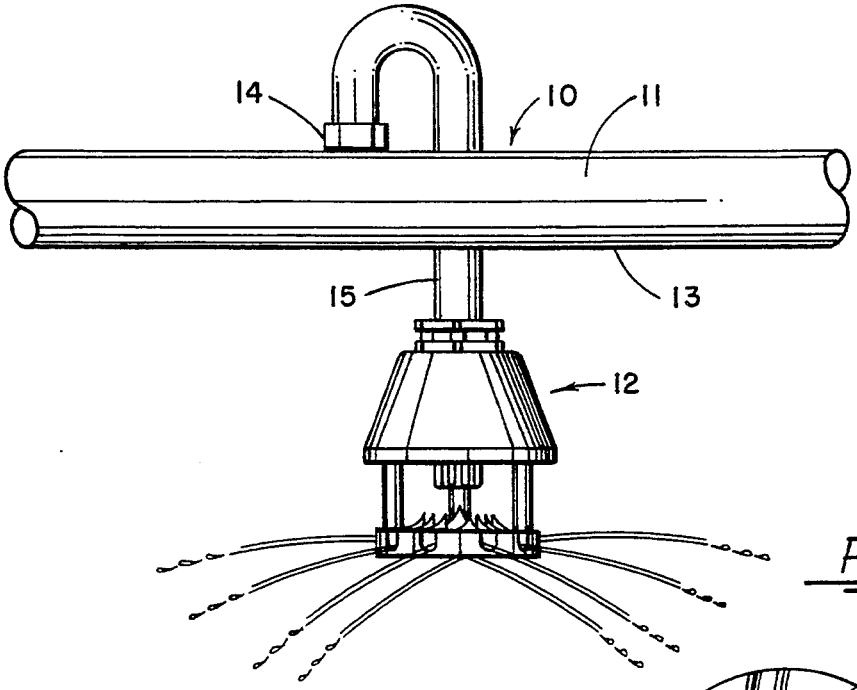
FIG. 1 is a side elevation of a portion of a central pivot irrigation system or the like having the present sprinkler head.
Figure 2:
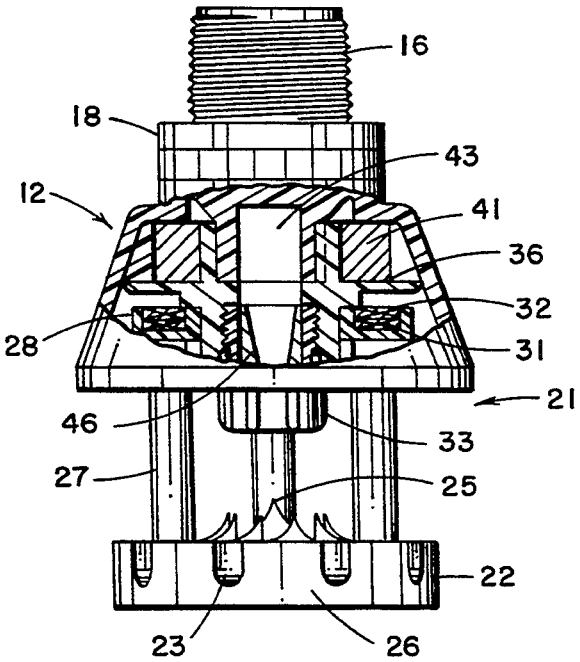
FIG. 2 is a side elevation of a wobbling irrigation sprinkler head in accordance with the present invention with a portion thereof cut away.

Referring to FIG. 1 of the drawings, a portion of a self-propelled mechanically moving irrigation system, such as a center pivot irrigation system 10 has a central irrigation conduit or water supply pipe 11 which is rotated on wheels in a field such as in a circular pattern for irrigating the field. The central water supply conduit 11 has a plurality of sprinkler heads 12 attached thereto in a spaced relationship to each other. In this case, each sprinkler head pipe 15 extends from the top 13 of the pipe 11 and includes a pipe coupling 14 attached thereto. The pipe 15 has a "U" shaped bend and has the sprinkler head 12 attached thereto.

Figure 3:
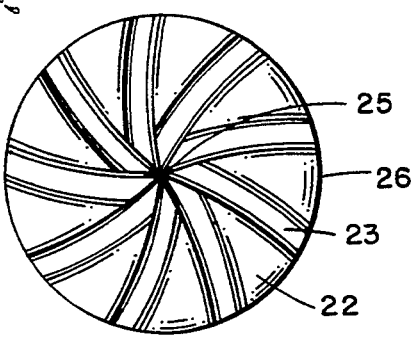
FIG. 3 is a top plan view of the deflection pad of the sprinkler head of FIG. 2.
Figure 5:
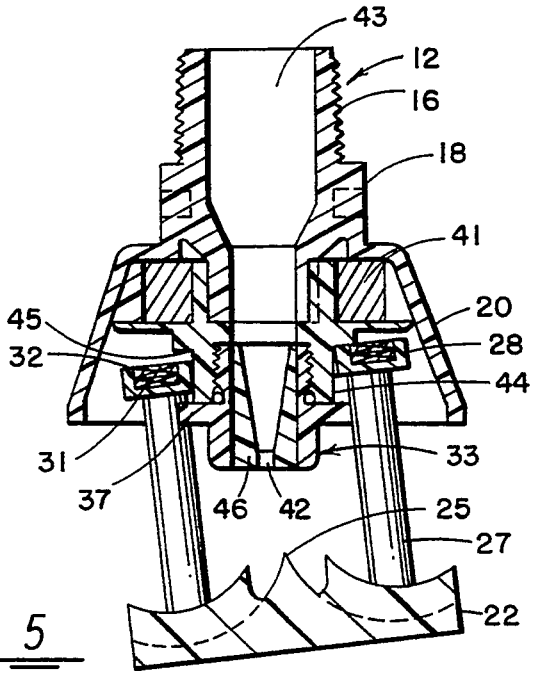
FIGS. 5 and 6 are sectional views taken through the sprinkler head of FIG. 2 showing different tilting positions of the deflection head as the deflection head rotates in a wobble.
Figure 4:
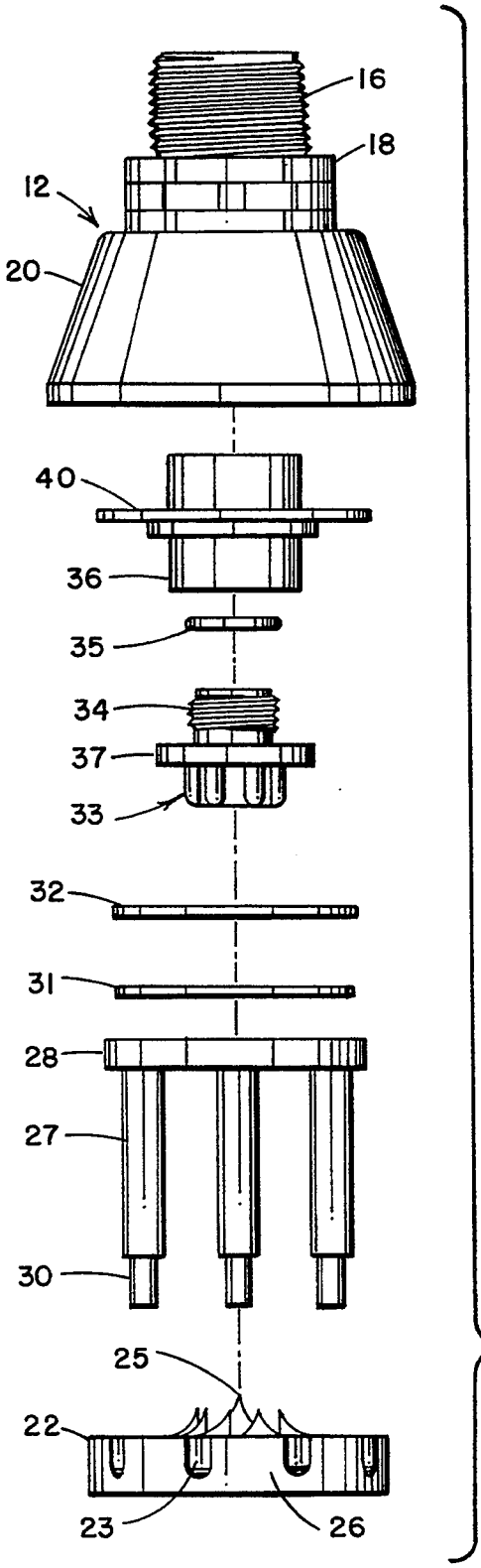
FIG. 4 is an exploded view of the sprinkler head of FIGS. 1–3.
Figure 6:
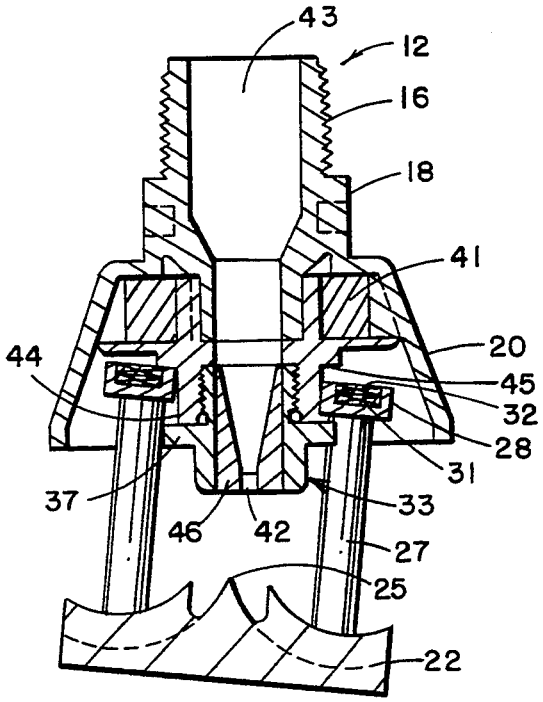

The sprinkler head 12, as seen in FIGS. 1–6, includes a threaded coupling 16 forming part of the wobbler base which has a wrench engaging surface 18 and a generally truncated cone base portion 20 extending from the wrench engaging portion 18. The base portion has an attached wobbling deflection head 21 having a deflection pad 22 attached thereto. The deflection pad 22 has a plurality of angled grooves 23 formed therein for deflecting water being impinged thereupon in a predetermined pattern with the ends of the grooves 23 extending above the deflection pad 22. All of the grooves come to a center point 25, as shown in FIG. 3, and open along the circular edge portion 26 of the deflection pad 22. The deflection pad is held by a plurality of posts 27. In this case, three posts have been used which are in turn all attached together with a post support base 28 and have pegged end portions 30 which are inserted into openings in the deflection pad 22 and attached thereto with screws. A ferric metal washer 31 may be attached to the top of the base portion 28 and a polymer ring 32 may be attached on top of that to seal the washer from the water which might cause it to rust. The deflection head 21, base 28 has an opening therethrough as does the metal washer 31 and the ring 32, as seen in FIGS. 5 and 6, which thereby allows a nozzle insert holder 33 to extend through the openings and to be threaded into the sprinkler head base with the external threads 34. An O-ring seal 35 is mounted thereover when the nozzle insert holder 33 is threaded into a neck insert 36. A nozzle insert holder 33 has a flanged portion 37 which will hold the post support 28 onto the cylindrical sleeve or neck insert portion which has a flanged portion 40 protruding therefrom and which is attached to form a part of the base portion with an adhesive attachment or the like. A circular magnet 41 is attached within the wobbler base and sealed therein and will act to attract the metal washer 31 mounted in the post base 28.

Because of the weight of the wobbling deflection head 21 relative to the attraction of the washer 32 to the magnet 41 the head will tilt to one side as the magnet draws one side of the ferric metal washer towards it to keep the deflector head 21 in a cocked position, such as shown in FIGS. 5 and 6, with the point 25 of the deflection pad center out of alignment with the opening 42 of the nozzle. The nozzle is interconnected with the water passageway 43 which feeds thereinto and directs the water from the outlet 42 in a constant stream which is directed onto the grooved deflection channels 23 spaced evenly around the deflection pad 22 to force the deflection pad 22 in the deflection head 21 to rotate by the force of the water impinging thereupon into the channels 23. Because of the cocked position, the deflection head 21 will rotate and wobble partially because of the loose connection of the enlarged opening 44 through the base 28, washer 31 and ring 32 over the cylindrical neck portion 38 and by the spacing above the flange 37 and below the ledge 45 so that the deflection head 21 has room to wobble as it rotates. The deflection head 21 wobble is initiated by the deflection head 21 being in a cocked position, as shown in FIGS. 5 and 6.

As seen in FIGS. 5 and 6, the water continues to impinge on the channels 23 off center from the center point 25 and passes through the channels 23 in a curved pattern forcing the rotation of the head 21 and simultaneously continuing to wobble the head which wobbling and rotation produces a more evenly distributed pattern of irrigation water from the sprinkler head being fed by a low pressure central water supply conduit 11 of a central pivot irrigation system or the like. Once the irrigation water has been shut off, the wobbling deflection head 21 will remain in a cocked position by the attraction between the magnet and the metal washer. In addition, the deflection head being mounted to the sprinkler head base with the nozzle insert holder 33, flange 37 allows the sprinkler to be rapidly disassembled by the unscrewing of the nozzle insert holder which allows the nozzle 46 to be exchanged for a different size or to be replaced when worn out and the entire wobbling deflection head can be removed and replaced. The entire sprinkler head except for the magnet 41 and the ferric metal washer 31 can be made of an injection molded polymer as desired and the magnet 41 and metal washer 31 can be sealed such as to protect them from corrosion.

It should be clear at this time that the present invention illustrates a wobbling irrigation sprinkler head which can advantageously be attached upside down or extending downward from a central pivot irrigation water line and is thereby self-draining and self-cocking to initiate the wobbling. However, the present invention should not be construed as limited to the forms shown which are to be considered illustrative rather than restrictive.

I claim:

1. A wobbling irrigation sprinkler head comprising:

a base having an attachment portion for attaching to a water supply;

a nozzle mounted to said base for directing water from said water supply therethrough;

a wobbling water deflecting head movably attached to said base and having a deflector pad thereon and having a deflection surface of predetermined shape positioned to deflect water being emitted from said nozzle and to rotate said wobbling water deflecting head;

said wobbling water deflecting head having a loose fitting sleeve portion surrounding a support arm on said base and held thereon with a base flange portion whereby said wobbling water deflecting head has a rotating wobbling motion for dispersion of water from said sprinkler head; and a magnet being attached to one portion of said sprinkler head for magnetically attracting a magnetically attractable member attached to another portion of said sprinkler head whereby said wobbling water deflector head is cocked to a tilted position relative to said base by said magnet's attraction for said magnetically attractable member.

2. A wobbling irrigation sprinkler head in accordance with claim 1 in which said magnet is imbedded in said base.

3. A wobbling irrigation sprinkler head in accordance with claim 2 in which said magnetically attractable member is a ferric metal washer shaped member attached to said wobbling water deflecting head.

4. A wobbling irrigation sprinkler head in accordance with claim 3 in which said ferric metal washer shaped member is attached to said sleeve portion of said wobbling water deflecting head.

5. A wobbling irrigation sprinkler head in accordance with claim 4 in which said base is made of a plastic and said magnet is imbedded therein.

6. A wobbling irrigation sprinkler head in accordance with claim 1 in which said base attaching portion is a threaded attachment for attachment to said water supply.

7. A wobbling irrigation sprinkler head in accordance with claim 6 in which said water supply includes an irrigation system central water supply conduit having said sprinkler head base attached thereto.

8. A wobbling irrigation sprinkler head in accordance with claim 7 including a downward extending water pipe attached to said irrigation system central water supply conduit at one end and having said sprinkler head attached to the other end thereof.

9. A wobbling irrigation sprinkler head in accordance with claim 1 in which said deflector head deflector pad surface of predetermined shape has grooved channels arcuately formed therein and shaped to rotate said deflector head.

10. A wobbling irrigation sprinkler head in accordance with claim 9 in which said deflector head deflector pad has protruding tips extending above the grooved pad deflector surface.

11. A wobbling irrigation sprinkler head in accordance with claim 1 in which said nozzle is removably attached to said base.

12. A wobbling irrigation sprinkler head in accordance with claim 11 in which said base flange portion is formed on a removably attached nozzle insert holder whereby said wobbling water deflector head can be removed from said base.

13. A wobbling irrigation sprinkler head in accordance with claim 12 in which said wobbling water deflecting head has a sleeve portion having a plurality of arms extending therefrom supporting said deflector pad thereto.

14. A wobbling irrigation sprinkler head in accordance with claim 1 in which said magnet is a ring magnet imbedded in said base.

15. A wobbling irrigation sprinkler head comprising:

a base having attachment means for attaching to a water supply and having a magnet mounted thereto;

a nozzle mounted to said base for directing water from said water supply therethrough;

a wobbling water deflecting head movably attached to said base and having a deflector pad thereon and having a deflection surface of predetermined shape positioned to deflect water being emitted from said nozzle and to rotate said wobbling water deflecting head;

a ferric metal member mounted to said wobbling water deflecting head in a position to tilt said deflecting head to one side in the absence of water impinging thereupon to thereby cock said deflecting head for initiating a wobbling motion upon water being impinged on said deflecting head deflector pad whereby said wobbling water deflecting head has a rotating wobbling motion for dispersion of water from said sprinkler head.

* * * * *